US007165836B2

(12) United States Patent
Ahlvin et al.

(10) Patent No.: US 7,165,836 B2
(45) Date of Patent: Jan. 23, 2007

(54) METHOD OF THERMALLY SEALING THE OVERCOAT OF MULTILAYER MEDIA

(75) Inventors: Eric L. Ahlvin, Corvallis, OR (US); Dan M. Weeks, Poway, CA (US); Radha Sen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 238 days.

(21) Appl. No.: 10/686,430

(22) Filed: Oct. 14, 2003

(65) Prior Publication Data

US 2005/0078129 A1 Apr. 14, 2005

(51) Int. Cl.
*B41J 2/01* (2006.01)

(52) U.S. Cl. ..... 347/102; 347/105

(58) Field of Classification Search ..... 347/100–102, 347/105

See application file for complete search history.

(56) References Cited

U.S. PATENT DOCUMENTS

| | | | | |
|---|---|---|---|---|
| 4,587,400 | A | 5/1986 | Kanamori et al. | |
| 4,832,984 | A | 5/1989 | Hasegawa et al. | |
| 5,059,989 | A * | 10/1991 | Eldridge et al. | 347/63 |
| 5,405,678 | A | 4/1995 | Bilodeau | |
| 5,682,194 | A | 10/1997 | Uyttendaele et al. | |
| 5,733,052 | A | 3/1998 | Suzuki | |
| 6,139,139 | A | 10/2000 | Stoffel et al. | |
| 6,151,037 | A * | 11/2000 | Kaufman et al. | 347/2 |
| 6,441,839 | B1 | 8/2002 | Masutani et al. | |
| 6,469,725 | B1 | 10/2002 | Nagahata | |

FOREIGN PATENT DOCUMENTS

| | | | |
|---|---|---|---|
| EP | 0 575 644 | A1 | 6/1992 |
| EP | 0 575 644 | B1 | 6/1992 |
| EP | 0858905 | A1 | 2/1998 |
| EP | 0858905 | B1 | 2/1998 |
| EP | 1016543 | A1 | 12/1999 |
| EP | 1078775 | A2 | 8/2000 |
| EP | 1078775 | A2 * | 2/2001 |
| EP | 1 888 574 | A2 | 3/2002 |
| JP | 10-85767 | | 3/1989 |
| JP | 20-92642 | | 4/1990 |
| JP | 2002240231 | A * | 8/2002 |
| WO | WO00/72984 | A1 | 12/2000 |

* cited by examiner

*Primary Examiner*—Shih-Wen Hsieh

(57) ABSTRACT

Mutilayer media is being developed which has inner ink-receiving micro-porous layer and an outer sealable porous surface coat, or topcoat. Ink printed on the media passes through the topcoat, and is absorbed by, or reacts with the inner ink-receiving layer. A thermal printhead is attached downstream of the print zone so that it passes over the area that was previously printed, and heats the topcoat. Where the topcoat is heated, the pores are closed and the closed pores provide a protective layer between the inner ink-receiving layer and the environment.

26 Claims, 3 Drawing Sheets

METHOD OF THERMALLY SEALING THE OVERCOAT OF MULTILAYER MEDIA

TECHNICAL FIELD

The present invention is directed to glossy print media having an ink-receiving layer, and, in particular, to a scheme for sealing an outer sealable porous surface coat thereon.

BACKGROUND ART

During the inkjet printing process, an inkjet ink comprising (1) an ink vehicle, comprising one or more solvents, and (2) a colorant, such as a dye or pigment, is introduced to the inkjet receiving layer(s) of an inkjet recording media. Specifically, in an effort to generate color prints that are photographic-like (e.g., of silver halide quality), glossy print media have been developed that comprise one or more ink-receiving layers on non-absorbent substrates.

The inkjet receiving layers absorb the ink vehicle delivered during the printing process. However, when the ink-receiving layer is applied to a non-absorbent substrate, the substrate provides no absorption capacity and as a result, the ink-receiving layer must be the sole absorbing and protective material.

Various solutions have been advanced for protecting the ink-receiving layer, such as laminating the print media or providing a topcoat or film. An example of a topcoat is called Thermal Transfer Overcoat (TTO), which uses a separate film that is fused to the media using heat and pressure. This is typically done with a heated roller.

There is a need for inexpensively sealing glossy print media to provide a printed product that is virtually indistinguishable from silver halide photographic prints.

DISCLOSURE OF INVENTION

In accordance with the embodiments disclosed herein, a combination of (1) a thermal printhead and (2) an inkjet printhead, both mounted in an inkjet printer, is provided. The inkjet printhead is configured for printing inkjet ink to form images on a sheet of print media. The print media includes a sealable porous topcoat on an ink-receiving microporous layer. The thermal printhead is adapted to seal the sealable porous topcoat by providing a source of heat to the sealable porous surface coat following the printing of images.

Further in accordance with the teachings herein, the combination above further includes (3) the print media including the sealable porous surface coat on the ink-receiving microporous layer. The thermal printhead is as described above.

Still further in accordance with the teachings herein, a method is provided for printing inkjet ink on a glossy print media including at least one ink-receiving layer and a sealable porous topcoat thereon. The method comprises:

providing the glossy print media;

placing the glossy print media in the inkjet printer having at least one inkjet printhead mounted on a movable carriage that moves perpendicular to a motion of travel of the glossy print media through the inkjet printer;

printing droplets of the inkjet ink on the glossy print media, through the sealable porous topcoat; and heating the glossy print media to seal the sealable porous topcoat as the print media is being advanced in the printer.

BEST MODES FOR CARRYING OUT THE INVENTION

Reference is made now in detail to specific embodiments, which illustrates the best modes presently contemplated by the inventors. Alternative embodiments are also briefly described as applicable.

In accordance with the teachings herein, a thermal printhead is provided in an inkjet printer for printing inkjet ink through a printhead to form images on a sheet of print media. The print media includes a sealable porous surface coat on an ink-receiving microporous layer. The thermal printhead is adapted to seal the sealable porous surface coat by providing a source of heat to the sealable porous surface coat following the printing of images.

Mutilayer print media for color inkjet printing has been developed that has an inner, or bottom, ink-receiving microporous layer and an outer, or top, sealable porous surface coat. Ink printed on the media passes through the topcoat, and is absorbed by, or reacts with the inner ink-receiving layer. When the topcoat is heated, the pores are closed and it provides a protective layer between the inner ink-receiving layer and the environment.

The basic idea of the present embodiment is to attach a thermal printhead downstream of the print zone so that it passes over the area that was previously printed. The thermal printhead could be a print bar or it could be a thermal printhead attached to the carriage or the thermal inkjet printhead and scanned by the carriage motion over the previously printed area. A print bar is a thermal printhead that spans the entire print zone. For example, to print 8 inches wide media, the print bar would be 8 inches long. It must be much larger (and more expensive) than a scanning head, so it is not as preferred as the thermal printhead. The time between the printing and the thermal sealing of the surface coat is dependent on the printmode and the distance between the printing element and the thermal printhead.

Previously, thermal transfer overcoat was applied as a film after the image was printed and then fused to the image with a heated roller that simultaneously applied pressure. The multilayer media being developed allows fusing with heat only. In this case, a thermal printing element can supply the heat. A thermal print bar is much less expensive than a heated roller, but it needs to span the entire print zone. On the other hand, a thermal printhead attached to the carriage only has to cover the height that the media is advanced between print passes. This advance distance is generally the swath height of the thermal inkjet printhead divided by the number of passes. For a ½ inch printhead, printing on photo media in a 4 pass print mode, the thermal element would only need to ⅛ inch tall, and could be very inexpensive. In this case, the thermal printhead only applies heat to the areas that have been printed, so the energy required to seal the surface coat is also minimized.

Figure 1:
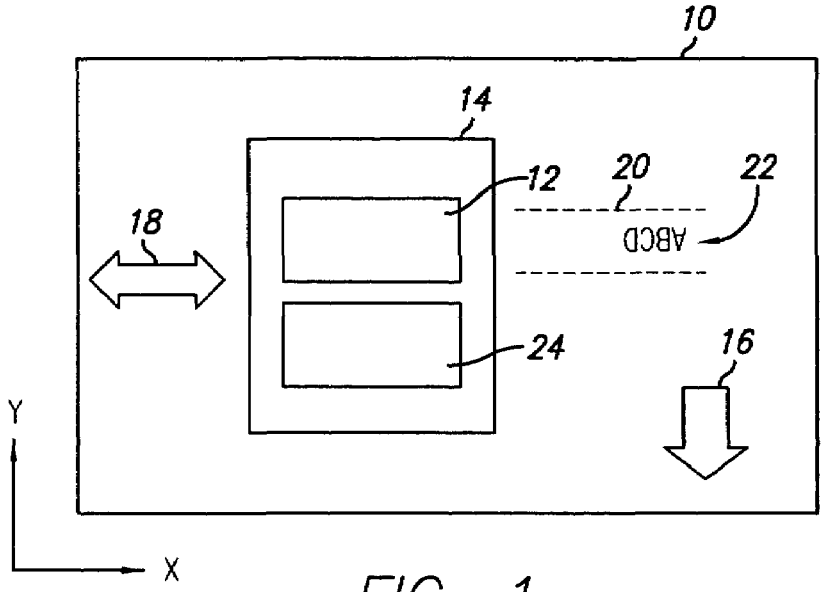
FIG. 1 depicts a schematic illustration of an embodiment of a heating element, specifically, a thermal printhead, used herein in conjunction with an inkjet printer.

FIG. 1 illustrates a print media 10 passing through a conventional inkjet printer that includes an inkjet printhead 12 supported and moved laterally on a carriage 14. The details of the inkjet printer, including the paper path, the pick rollers, platen, drive motor and electronics, etc. are well known in the art and are not relevant to the discussion herein.

The print media 10 moves along a media advance direction, denoted by arrow 16. The carriage 14 moves to and fro in a direction perpendicular to the media advance direction 16, denoted by arrow 18. The movement of the inkjet printhead 12 establishes a print zone 20 in which characters and other images 22 are formed.

In accordance with the teachings herein, a thermal printhead 24 is preferably mounted on the carriage 14 in a position following the printhead 12, such that the thermal printhead, which emits heat, does so after the images 22 are printed.

Figure 2:
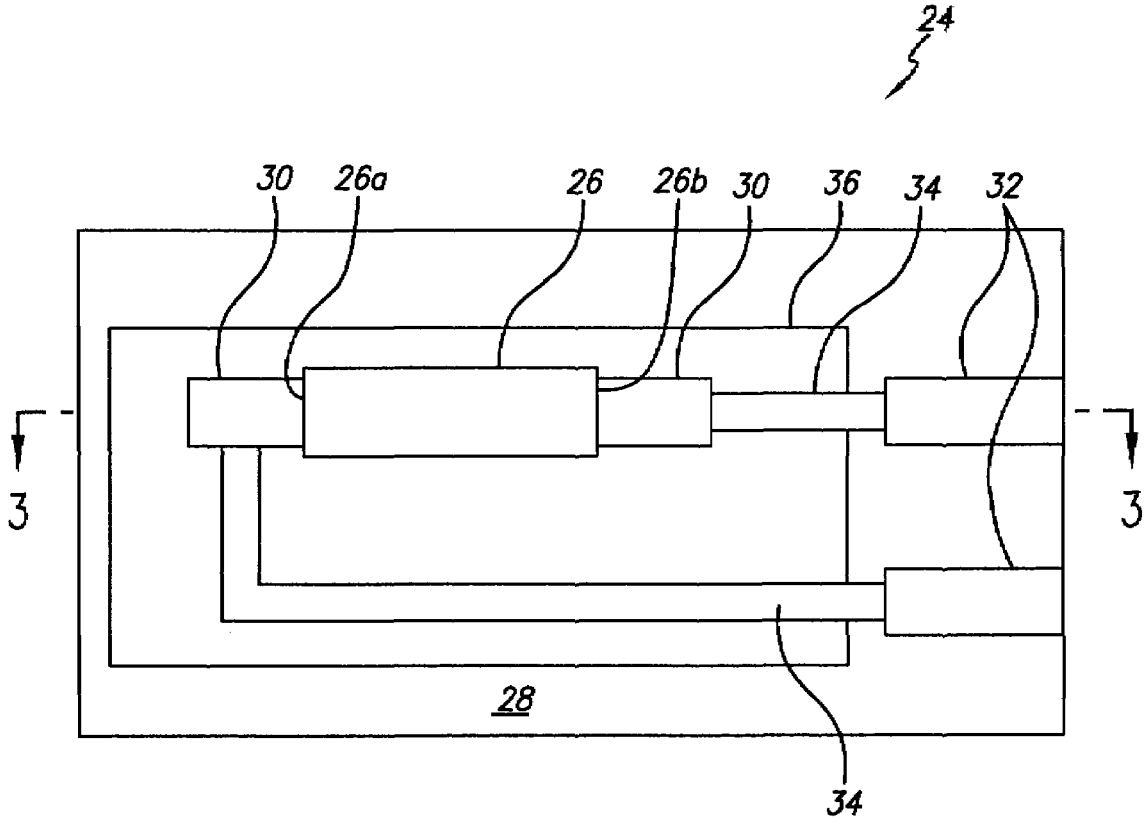
FIG. 2 is a top plan view of an embodiment of the thermal printhead of FIG. 1.
Figure 3:
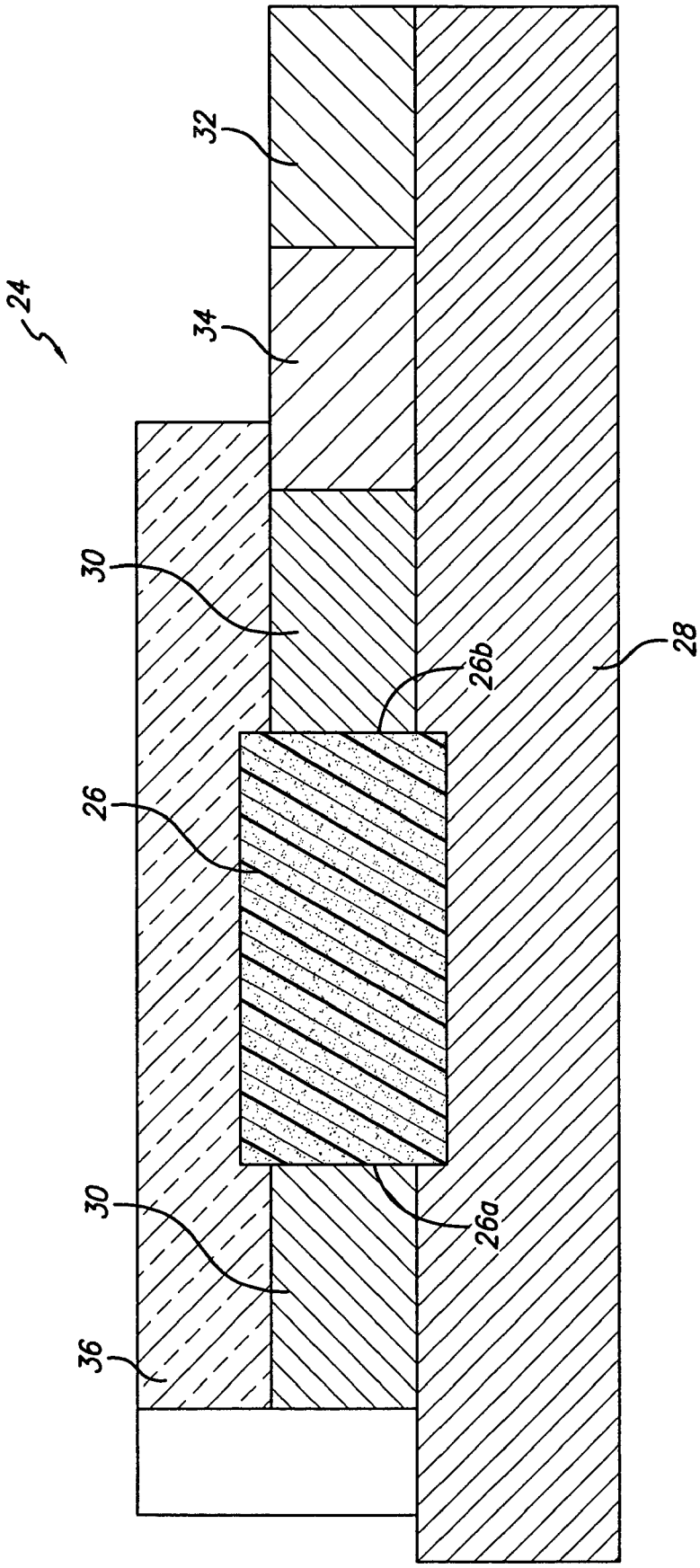
FIG. 3 is a cross-sectional view of an embodiment of the thermal printhead, taken along the line 3—3 of FIG. 2.

One embodiment of the thermal printhead 24 is depicted in FIGS. 2 (top plan view) and 3 (cross-sectional view). The thermal printhead 24 comprises a resistive heating element 26 formed on a substrate 28. The resistive heating element 26 is contacted at opposite ends 26*a*, 26*b* by contacts 30. The contacts 30 are respectively connected to connectors 32 via conductors 34. A passivation layer 36 covers at least the resistive heating element 26, the contacts 30, and a portion of the conductors 34. Such a thermal printhead 24 is known in the art and has been used in a variety of Hewlett-Packard products, including HP2671A, HP2673A, and HP2671G.

In designing the resistive heating element 26 of the thermal printhead 24, the y dimension of the heating element must be greater than or equal to the distance from the top to the bottom nozzle of the thermal inkjet head divided by the number of passes (plus mechanical and paper advance tolerances). The thermal printhead 24 should not extend beyond the x dimension of the carriage that holds the thermal inkjet printhead in order not to increase the overtravel and impact throughput. The shape in that dimension does not matter. For example, a "D"- or "O"-shaped thermal printhead would work just as well as a rectangular thermal printhead. However, almost all thermal printheads are rectangular for ease of manufacture and cost effective use of the substrate materials.

The resistive heating element 26 is, accordingly, preferably rectangular in shape and comprises thin film or thick film resistor, for example, a tantalum-aluminum (Ta—Al) alloy or carbon paste or other commonly available resistor materials. Thin film and thick film resistors are well known in the art. The substrate 28 comprises an insulating material, such as a ceramic, e.g., glass, silica, or alumina or other commonly available insulating materials. The contacts 30 may be the same or different material and comprise aluminum or gold, which is formed by e.g., deposition or applying a paste and firing it. Further, a solder can be formed on top of the contact for permanent connection to a flex cable or discrete wires. The connectors 32 may be the same or different and may comprise aluminum, copper with gold, or solder on top or other conventional electrical conductor material. The conductors 34 may be the same or different and may comprise aluminum or copper or other conventional electrical conductor material.

The particular selection of materials for the contacts 30, the connectors 32, and the conductors 34 depends on adhesion and electrical connection between the various components. Such selection is considered within the capabilities of one skilled in this art, requiring no undue experimentation. Thermal printheads themselves are known, and have been used in printing on thermal paper. Examples of such thermal printheads are listed above.

The passivation layer 36 comprises any conventional passivation material, such as fused glass or silica. The passivation layer 36 is typically applied as a paste and then fused by heating.

As noted above, the print media 10 comprises at least one microporous ink-receiving layer, typically formed on a supporting substrate, with a sealable porous topcoat.

The supporting substrate (not shown) typically comprises a non-permeable (non-air permeable) material, such as a synthetic film, e.g., polyethylene terephthalate, polypropylene, polycarbonate, polyethylene, nylon, Mylar, etc., or a resin-coated paper (e.g., photobase paper, usually paper coated with high or low density polyethylene, polypropylene, or polyester by co-extrusion).

The microporous ink-receiving layer comprises one or more pigments and one or more binders, and has a porosity in the range of 25 to 28 $cm^3/m^2$. Other components, such as mordants and/or polymers may be added, but these are not germane to the present discussion.

The pigment(s) is(are) selected from the group consisting of highly porous silica, alumina, hydrates of alumina (e.g., pseudo-boehmite), titania, zirconia, base metal oxides, carbonates, glass beads, and hard ball (non-film forming latexes). The major requirement for the pigment is that it have a hydrophilic surface (so that it will be easily wetted by the aqueous ink) and high surface area (to improve absorption capacity). The basic nature of the binder surface (ability to absorb anions) is an additional bonus because it helps to immobilize anionic dyes (practically all dyes used in the inkjet ink formulations are anionic).

The ink-receiving layer includes one or more binders for the purpose of the increasing the coating layer strength. The binder, for example, can be any of a number of water-soluble polymers, such as gelatin, polyvinyl pyrrolidone, water-soluble cellulose derivatives, polyvinyl alcohol or its derivatives, polyacrylamide, polyacrylic acid, different water-soluble acrylic acid copolymers, etc. Polyvinyl alcohol or its water-soluble/water-dispersible derivatives are the most preferred binder embodiments.

The amount of the binder should be sufficient to bind the pigments and polymer particles 16 together, but low enough to avoid blocking of the physical porosity between particles. The concentration of the binder is within the range of about 1 to 50 wt %, preferably about 1 to 10 wt %, with the balance the pigment.

The sealable porous topcoat comprises a material that is sealable by the thermal printhead 24. Examples of such materials include at least one of the binders listed above, which may be the same or different as in the ink-receiving layer(s). Alternatively, and preferably, the topcoat comprises a film-forming latex pigment, having a pore size of about 4 to 15 nm, based on the particle size distribution of the latex pigments.

Further examples of porous topcoat compositions that are suitably employed in the practice of the present embodiments are taught in application Ser. No. 10/313,689, filed Dec. 4, 2002, entitled "Sealable Topcoat for Porous Media", by Radha Sen and in application Ser. No. 10/387,661, filed Mar. 12, 2003, entitled "A Print Medium Including a Heat-Sealable Layer", by Radha Sen, both assigned to the same assignee as the present application. The contents of both applications are incorporated herein by reference.

In the '689 application, an anionic porous topcoat comprising polymer particles having a glass transition temperature ($T_g$) in the range of 60° to 100° C. and a size less than 250 nanometers is applied on a porous ink-receptive coating. The topcoat is then dried, an image is printed thereon, and the topcoat is heated until it becomes fused.

In the '661 application, a heat-sealable layer is provided on a print medium, comprising a first component and a second component, having different particle sizes and different glass transition temperatures. Following printing thereon, the heat-sealable layer is sealed by heating to a temperature above both glass transition temperatures.

The configuration of the print media 10 ensures that the ink penetrates through the porous topcoat and into the ink-receiving layer. In some instances, there may be more than one ink-receiving layer. For example, more than one ink-receiving layer could be used to facilitate coating process or to apply a different functionality, such as a glossing layer. However, in general, there is one ink-receiving layer in which the ink is absorbed.

Figures 4A, 4B, 4C:
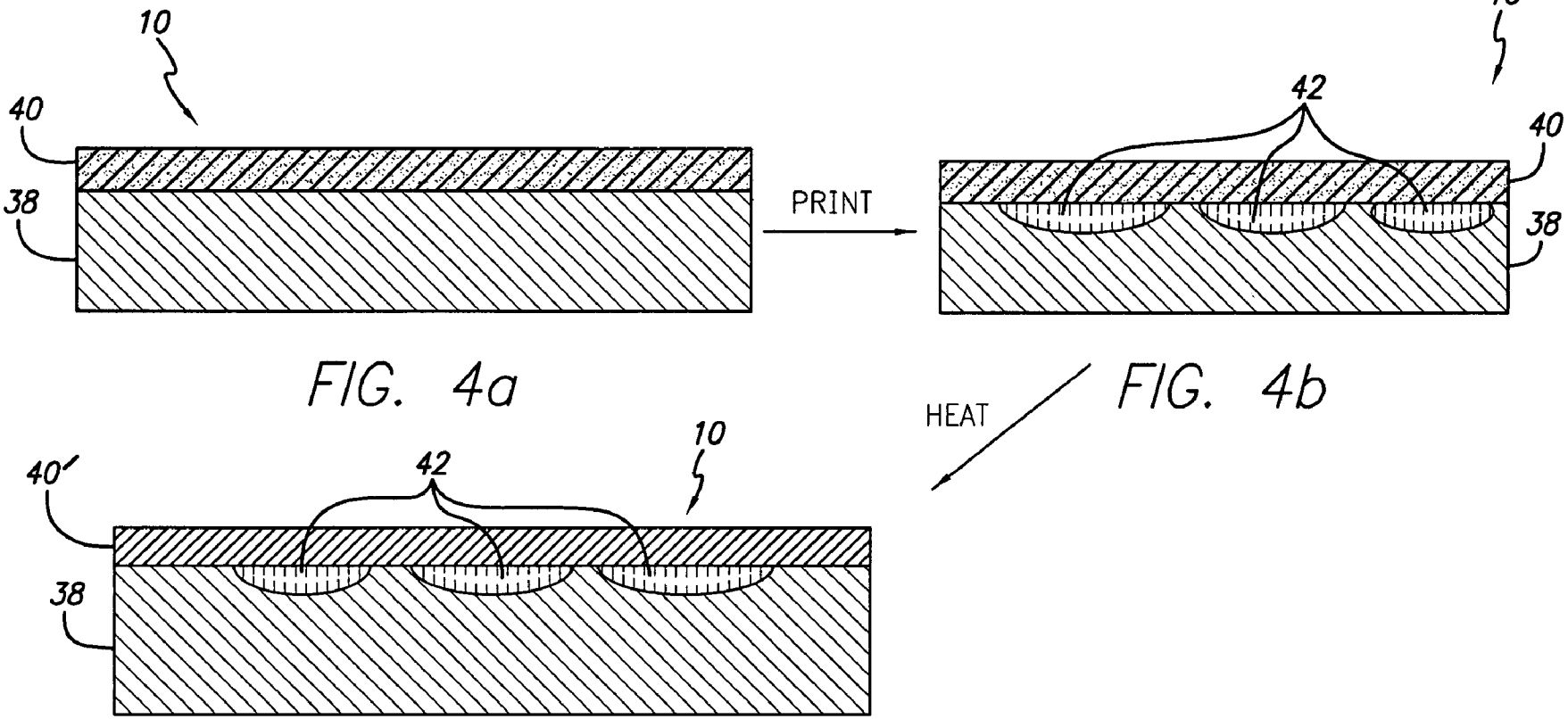
FIGS. 4*a*–4*c* depict an example of the sequence of steps in printing inkjet ink on a print media having at least one ink-receiving layer and a sealable porous topcoat thereon and sealing the topcoat according to an embodiment of the present invention.

FIGS. 4*a*–4*c* depict the sequence of steps involved in printing and sealing the print media. As shown in FIG. 4*a*, print media 10 comprises ink-receiving layer 38, on which is formed sealable topcoat 40. The ink-receiving layer 38 has been formed on a substrate (not shown).

The print media 10 is printed on with ink 42. Because of the porosity of the topcoat 40, the ink 42 penetrates down to the ink-receiving layer 38. The resulting configuration is depicted in FIG. 4*b*. Finally, the topcoat 40 is sealed with heat to formed a sealed topcoat 40', as shown in FIG. 4*c*. Pressure may be used in conjunction with the heat, but is not necessary to realize the benefits of the teachings herein. Essentially, the porous layer 40 undergoes a phase change when heated to its phase change temperature, and converts from a porous material to a relatively non-porous material 40'. The final product simulates the effects of lamination, without the need for a separate laminating step.

The teachings herein allow a low incremental cost in a printer that can use sealable topcoat media. Once the topcoat is sealed, the print media has much better waterfastness and lightfastness than traditional inkjet media. The end result is a thermal inkjet output with the durability of a silver halide photo print from a low cost printer.

An advantage over what has been done before is that it allows a much lower cost printer implementation due to the thermal printhead being less expensive than a heated roller and consumes much less power than a heated roller would.

INDUSTRIAL APPLICABILITY

The use of a sealable porous topcoat, in conjunction with at least one ink-receiving layer, and a mechanism for sealing the topcoat are expected to find use in printing of glossy print media.

What is claimed is:

1. In combination, (1) a thermal printhead and (2) an inkjet printhead, both mounted in an inkjet printer, said inkjet printhead configured for printing inkjet ink to form images on a sheet of print media, said print media including a sealable porous topcoat on an ink-receiving microporous layer, said thermal printhead adapted to seal said sealable porous topcoat by providing a source of heat to said sealable porous surface coat following said printing of images.

2. The combination of claim 1 wherein said inkjet printhead is supported and moved on a carriage across a scan axis, along a print zone, perpendicular to a direction of print media advance and wherein said thermal printhead is positioned with said inkjet printhead on said carriage to seal said sealable porous surface coat following printing of said image.

3. The combination of claim 2 wherein said thermal printhead is positioned downstream of said inkjet printhead relative to said print zone.

4. The combination of claim 1 wherein said thermal printhead is configured to apply heat only to areas that have been printed, thereby minimizing energy required to seal said porous topcoat.

5. The combination of claim 4 wherein said thermal printhead has a height that is at least equal to a swath height of said inkjet printhead divided by the number of passes made by said inkjet printhead.

6. In combination, (1) a thermal printhead, (2) an inkjet printhead, both mounted in an inkjet printer, said inkjet printhead configured for printing inkjet ink to form images on a sheet of print media, and (3) said print media including a sealable porous surface coat on an ink-receiving microporous layer, said thermal printhead adapted to seal said sealable porous surface coat by providing a source of heat to said sealable porous surface coat following said printing of images.

7. The combination of claim 6 wherein said inkjet printhead is supported and moved on a carriage across a scan axis, along a print zone, perpendicular to a direction of print media advance and wherein said thermal printhead is positioned with said inkjet printhead on said carriage to seal said sealable porous surface coat following printing of said image.

8. The combination of claim 7 wherein said thermal printhead is positioned downstream of said inkjet printhead relative to said print zone.

9. The combination of claim 6 wherein said at least one ink-receiving layer comprises at least one pigment and at least one binder.

10. The combination of claim 9 wherein said at least one pigment is selected from the group consisting of highly porous silica, alumina, hydrates of alumina, titania, zirconia, base metal oxides, carbonates, glass beads, and hard ball, wherein said at least one binder is selected from the group consisting of gelatin, polyvinyl pyrrolidone, water-soluble cellulose derivatives, polyvinyl alcohol and its derivatives, polyacrylamide, polyacrylic acid, water-soluble acrylic acid co-polymers, and wherein said at least one ink-receiving layer has a porosity within a range of 25 to 28 $cm^3/m^2$.

11. The combination of claim 6 wherein said sealable porous top-coat comprises either a binder selected from the group consisting of gelatin, polyvinyl pyrrolidone, water-soluble cellulose derivatives, polyvinyl alcohol and its derivatives, polyacrylamide, polyacrylic acid, water-soluble acrylic acid co-polymers, or a pigment comprising a film-forming latex, and wherein said topcoat has a pore size in a range of about 4 to 15 nm.

12. The combination of claim 6 wherein said thermal printhead is configured to apply heat only to areas that have been printed, thereby minimizing energy required to seal said porous topcoat.

13. The combination of claim 12 wherein said thermal printhead has a height that is at least equal to a swath height of said inkjet printhead divided by the number of passes made by said inkjet printhead.

14. In combination, (1) a thermal printhead, (2) an inkjet printhead, both mounted in an inkjet printer, said inkjet printhead configured for printing inkjet ink to form images on a sheet of print media, and (3) said print media including a sealable porous surface coat on an ink-receiving microporous layer, said thermal printhead adapted to seal said sealable porous surface coat by providing a source of heat to said sealable porous surface coat following said printing of images, wherein said at least one ink-receiving layer comprises at least one pigment and at least one binder and wherein said at least one pigment is selected from the group consisting of highly porous silica, alumina, hydrates of alumina, titania, zirconia, base metal oxides, carbonates, glass beads, and hard ball, wherein said at least one binder is selected from the group consisting of gelatin, polyvinyl pyrrolidone, water-soluble cellulose derivatives, polyvinyl alcohol and its derivatives, polyacrylamide, polyacrylic acid, water-soluble acrylic acid co-polymers, and wherein said at least one ink-receiving layer has a porosity within a range of 25 to 28 $cm^3/m^2$.

15. The combination of claim 14 wherein said inkjet printhead is supported and moved on a carriage across a scan axis, along a print zone, perpendicular to a direction of print media advance and wherein said thermal printhead is positioned with said inkjet printhead on said carriage to seal said sealable porous surface coat following printing of said image.

16. The combination of claim 15 wherein said thermal printhead is positioned downstream of said inkjet printhead relative to said print zone.

17. The combination of claim 14 wherein said sealable porous top-coat comprises either a binder selected from the group consisting of gelatin, polyvinyl pyrrolidone, water-soluble cellulose derivatives, polyvinyl alcohol and its derivatives, polyacrylamide, polyacrylic acid, water-soluble acrylic acid co-polymers, or a pigment comprising a film-forming latex, and wherein said topcoat has a pore size in a range of about 4 to 15 nm.

18. The combination of claim 14 wherein said inkjet printhead is supported and moved on a carriage across a scan axis, along a print zone, perpendicular to a direction of print media advance and wherein said thermal printhead is positioned with said inkjet printhead on said carriage to seal said sealable porous surface coat following printing of said image.

19. The combination of claim 18 wherein said thermal printhead is positioned downstream of said inkjet printhead relative to said print zone.

20. The combination of claim 14 wherein said thermal printhead is configured to apply heat only to areas that have been printed, thereby minimizing energy required to seal said porous topcoat.

21. The combination of claim 20 wherein said thermal printhead has a height that is at least equal to a swath height of said inkjet printhead divided by the number of passes made by said inkjet printhead.

22. In combination, (1) a thermal printhead, (2) an inkjet printhead, both mounted in an inkjet printer, said inkjet printhead configured for printing inkjet ink to form images on a sheet of print media, and (3) said print media including a sealable porous surface coat on an ink-receiving microporous layer, said thermal printhead adapted to seal said sealable porous surface coat by providing a source of heat to said sealable porous surface coat following said printing of images, wherein said sealable porous topcoat comprises either a binder selected from the group consisting of gelatin, polyvinyl pyrrolidone, water-soluble cellulose derivatives, polyvinyl alcohol and its derivatives, polyacrylamide, polyacrylic acid, water-soluble acrylic acid co-polymers, or a pigment comprising a film-forming latex, and wherein said topcoat has a pore size in a range of about 4 to 15 nm.

23. The combination of claim 22 wherein said at least one ink-receiving layer comprises at least one pigment and at least one binder.

24. The combination of claim 23 wherein said at least one pigment is selected from the group consisting of highly porous silica, alumina, hydrates of alumina, titania, zirconia, base metal oxides, carbonates, glass beads, and hard ball, wherein said at least one binder is selected from the group consisting of gelatin, polyvinyl pyrrolidone, water-soluble cellulose derivatives, polyvinyl alcohol and its derivatives, polyacrylamide, polyacrylic acid, water-soluble acrylic acid co-polymers, and wherein said at least one ink-receiving layer has a porosity within a range of 25 to 28 $cm^3/m^2$.

25. The combination of claim 22 wherein said thermal printhead is configured to apply heat only to areas that have been printed, thereby minimizing energy required to seal said porous topcoat.

26. The combination of claim 25 wherein said thermal printhead has a height that is at least equal to a swath height of said inkjet printhead divided by the number of passes made by said inkjet printhead.

* * * * *